US007273059B2

(12) United States Patent
Lee

(10) Patent No.: US 7,273,059 B2
(45) Date of Patent: Sep. 25, 2007

(54) COSMETIC POWDER APPLIANCE

(76) Inventor: Young Gu Lee, 1496-21 Kwanyang-dong, Dongan-ku, Anyany city, Kyungki-do (KR)

( * ) Notice: Subject to any disclaimer, the term of this patent is extended or adjusted under 35 U.S.C. 154(b) by 239 days.

(21) Appl. No.: 11/117,318

(22) Filed: Apr. 29, 2005

(65) Prior Publication Data

US 2006/0201528 A1 Sep. 14, 2006

(30) Foreign Application Priority Data

Mar. 11, 2005 (KR) ..... 20-2005-0006610

(51) Int. Cl.
*A45D 33/02* (2006.01)

(52) U.S. Cl. ..... 132/299; 132/298

(58) Field of Classification Search ..... 132/299, 132/298, 305, 293–296, 297
See application file for complete search history.

(56) References Cited

U.S. PATENT DOCUMENTS 3,470,890 A * 10/1969 Nakata ..... 132/298

FOREIGN PATENT DOCUMENTS

KR 20-0262453 1/2002

KR 10-0454385 10/2004

* cited by examiner

*Primary Examiner*—Robyn Doan
(74) *Attorney, Agent, or Firm*—Lowe Hauptman & Berner LLP

(57) ABSTRACT

Disclosed is a cosmetic powder appliance. The cosmetic powder appliance includes a powder receptacle including a lower powder receptacle and an upper powder receptacle having a cylindrical section and a stepped section formed at an upper portion of the cylindrical section, in which the stepped section is formed at a center portion thereof with a passage hole, the cylindrical section is detachably coupled to an upper portion of the lower powder receptacle in such a manner that the lower powder receptacle is covered with the upper powder receptacle, a puffer including a puffer head provided at an upper surface of the stepped section and formed at a center portion thereof with an exhaust hole communicated with the passage hole and a puffer cover for covering the puffer head, and a valve unit installed in the puffer head in order to selectively open the passage hole only when the puffer touches a predetermined cosmetic area. The powder stored in the powder receptacle is prevented from being exhausted to an exterior when a user uses the cosmetic powder appliance.

7 Claims, 9 Drawing Sheets

COSMETIC POWDER APPLIANCE

BACKGROUND OF THE INVENTION

1. Field of the Invention

The present invention relates to a cosmetic powder appliance, and more particularly to a cosmetic powder appliance including a powder receptacle and a puffer integrally formed with the powder receptacle in order to exhaust powder to a cosmetic area.

2. Description of the Prior Art

If a powder receptacle is fabricated separately from a puffer, it is inconvenienced for users to carry the powder receptacle and the puffer. Korean Utility Model Application No. 2001-26125 discloses a puffer equipped with a powder receptacle, in which the powder receptacle is integrally formed with the puffer so as to allow users to conveniently carry the puffer and the powder receptacle.

FIG. 8 is an exploded perspective view illustrating a conventional cosmetic powder appliance, FIG. 9 is an assembled perspective view illustrating the conventional cosmetic powder appliance, and FIG. 10 is an assembled sectional view illustrating the conventional cosmetic powder appliance.

As shown In FIGS. 8 to 10, the conventional cosmetic powder appliance includes a powder receptacle 111, a puffer 130 coupled to an upper end of the powder receptacle 111, and a cap (not shown, see reference numeral 71 in FIG. 1) coupled to the powder receptacle 111 in such a manner that the cap may surround the puffer 130. An upper portion of the powder receptacle 111 is opened.

The powder receptacle 111 includes a lower powder receptacle 111*a* and a middle powder receptacle 111*b* coupled to an upper end of the lower powder receptacle 111*a* by means of a locking section 111*c* in the form of a strip.

The puffer 130 includes a puffer head 140 having a substantially hexagonal sectional shape, and a support section 132 linearly extending from an underside of the puffer head 140.

The puffer head 140 is formed at a center portion thereof with a guide hole 140*a*, which extends lengthwise along the puffer head 140.

A guide pipe 133 is inserted into a lower end of the guide hole 140*a* and an exhaust port 140*b* having a sectional area larger than that of the guide hole 140*a* is formed at an upper end of the guide hole 140*a*.

The puffer 130 having the above structure is coupled to the powder receptacle 111 by inserting the support section 132 into the middle powder receptacle 111*b*.

A puffer cover 131 is coupled to the puffer head 140 in such a manner that the puffer head 140 can be surrounded by means of the puffer cover 131.

Hereinafter, an operation of the cosmetic powder appliance having the above structure will be described.

First, the middle powder receptacle 111*b* coupled with the puffer 130 is separated from the lower powder receptacle 111*a*, and powder is stored in the lower powder receptacle 111*a*.

Then, the middle powder receptacle 111*b* coupled with the puffer 130 is assembled with the upper end of the lower powder receptacle 111*a*.

After that, the user touches a cosmetic area (that is, an area to which powder is applied) by using the buffer 130 while gripping the lower powder receptacle 111*a*.

If the user touches the cosmetic area by using the buffer 130, the powder stored in the lower powder receptacle 111*a* is collected in the exhaust port 140*b* while sequentially passing through the middle powder receptacle 111*b* and the guide hole 140*a*.

The powder collected in the exhaust port 140*b* is finally exhausted to the cosmetic area through the puffer cover 131.

However, according to the conventional cosmetic powder appliance, a powder exhaust path including the guide hole 140*a* and the exhaust port 140*b* is always communicated with the powder receptacle 111, so that the powder stored in the lower powder receptacle 111 may be exhausted to an exterior even if the user does not use the conventional cosmetic powder appliance.

SUMMARY OF THE INVENTION

Accordingly, the present invention has been made to solve the above-mentioned problems occurring in the prior art, and an object of the present invention is to provide a cosmetic powder appliance, in which a powder exhaust path is communicated with a powder receptacle only when a user uses the cosmetic powder appliance.

In order to accomplish the above object, according to the present invention, there is provided a cosmetic powder appliance comprising: a powder receptacle including a lower powder receptacle and an upper powder receptacle having a cylindrical section and a stepped section formed at an upper portion of the cylindrical section, the stepped section being formed at a center portion thereof with a passage hole, the cylindrical section being detachably coupled to an upper portion of the lower powder receptacle in such a manner that the lower powder receptacle is covered with the upper powder receptacle; a puffer including a puffer head provided at an upper surface of the stepped section and formed at a center portion thereof with an exhaust hole communicated with the passage hole and a puffer cover for covering the puffer head; and a valve unit installed in the puffer head in order to selectively open the passage hole only when the puffer touches a predetermined cosmetic area.

According to the preferred embodiment of the present invention, the valve unit includes a lifting member having a lifting plate formed with a plurality of guide slots and a lifting shaft downwardly extending from a center portion of an underside of the lifting plate, a valve plate coupled to a lower end of the lifting plate in parallel to the lifting plate, and an elastic member installed lengthwise along the lifting shaft. The lifting shaft passes through the passage hole, the valve plate is aligned below the passage hole, and the elastic member is installed between a bottom surface of the exhaust hole and the lifting plate.

The guide slots are formed at an outer peripheral portion of the lifting plate and communicated with each other through a cross-shaped connection slot in such a manner that the powder introduced into the exhaust hole through the guide slots is prevented from being concentrated onto a predetermined portion of the puffer cover.

The puffer head includes a diffusing plate installed around the exhaust hole and having an upper surface inwardly inclined towards a center portion thereof in order to allow the powder to be uniformly distributed over the whole area of the puffer cover.

The puffer includes a porous plate having a plurality of pores, which are uniformly distributed, and being interposed between the puffer cover and the diffusing plate in such a manner that the powder diffused through the diffusing plate is prevented from being concentrated onto a predetermined portion of the puffer cover.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, the present invention will be described with reference to accompanying drawings.

Figure 1:
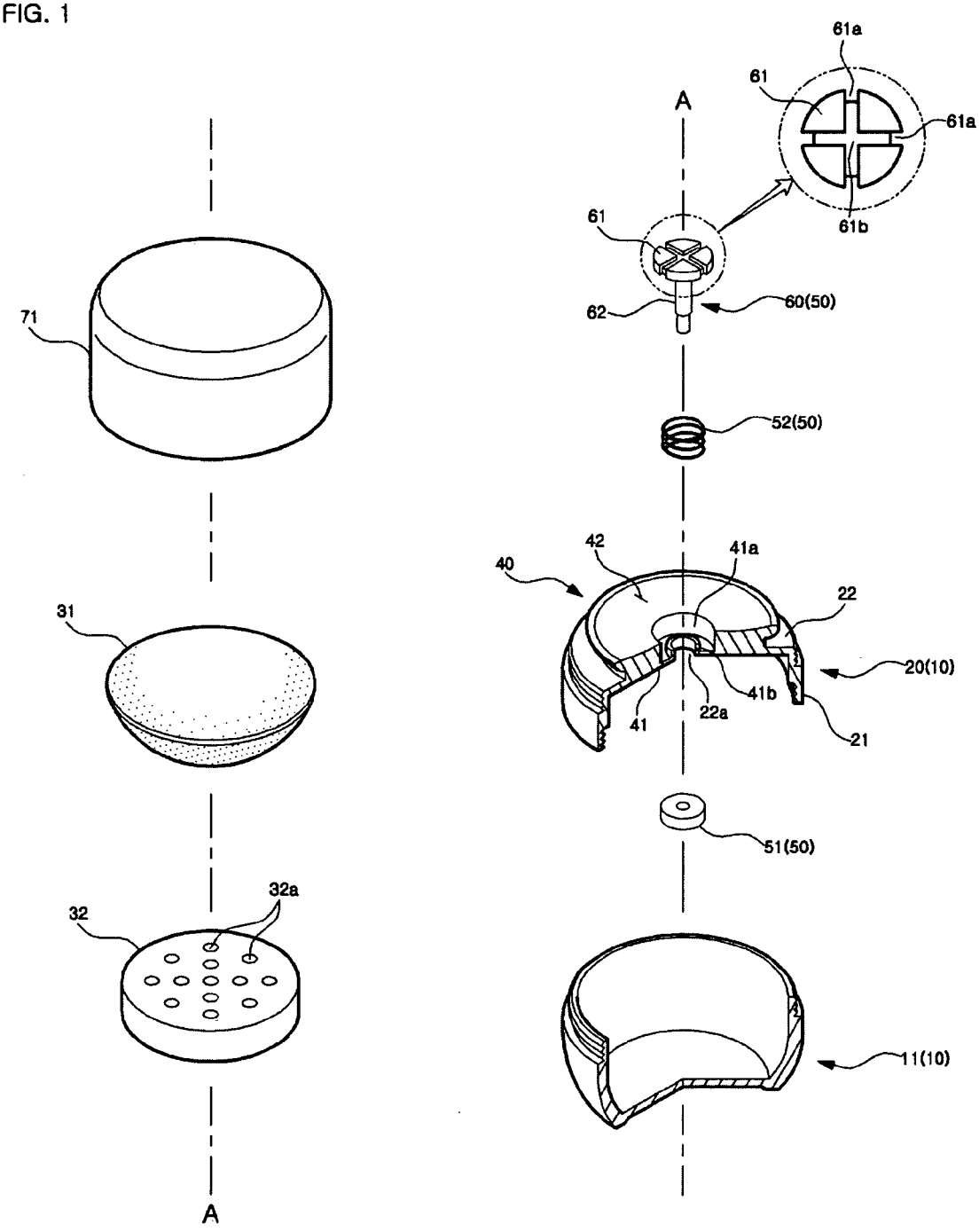
FIGS. 1 to 3 are exploded perspective views of a cosmetic powder appliance according to one embodiment of the present invention.
Figure 2:
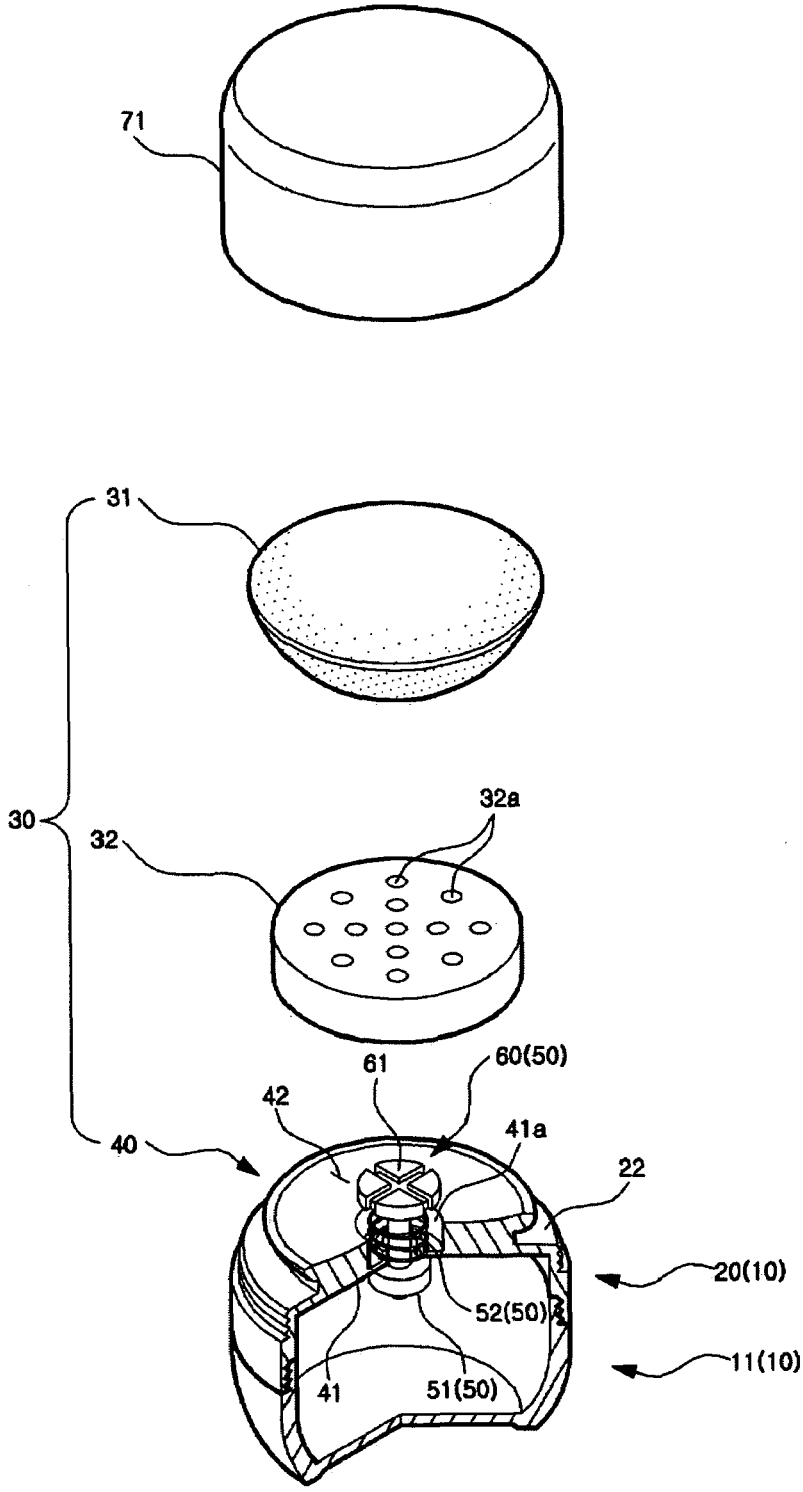
Figure 3:
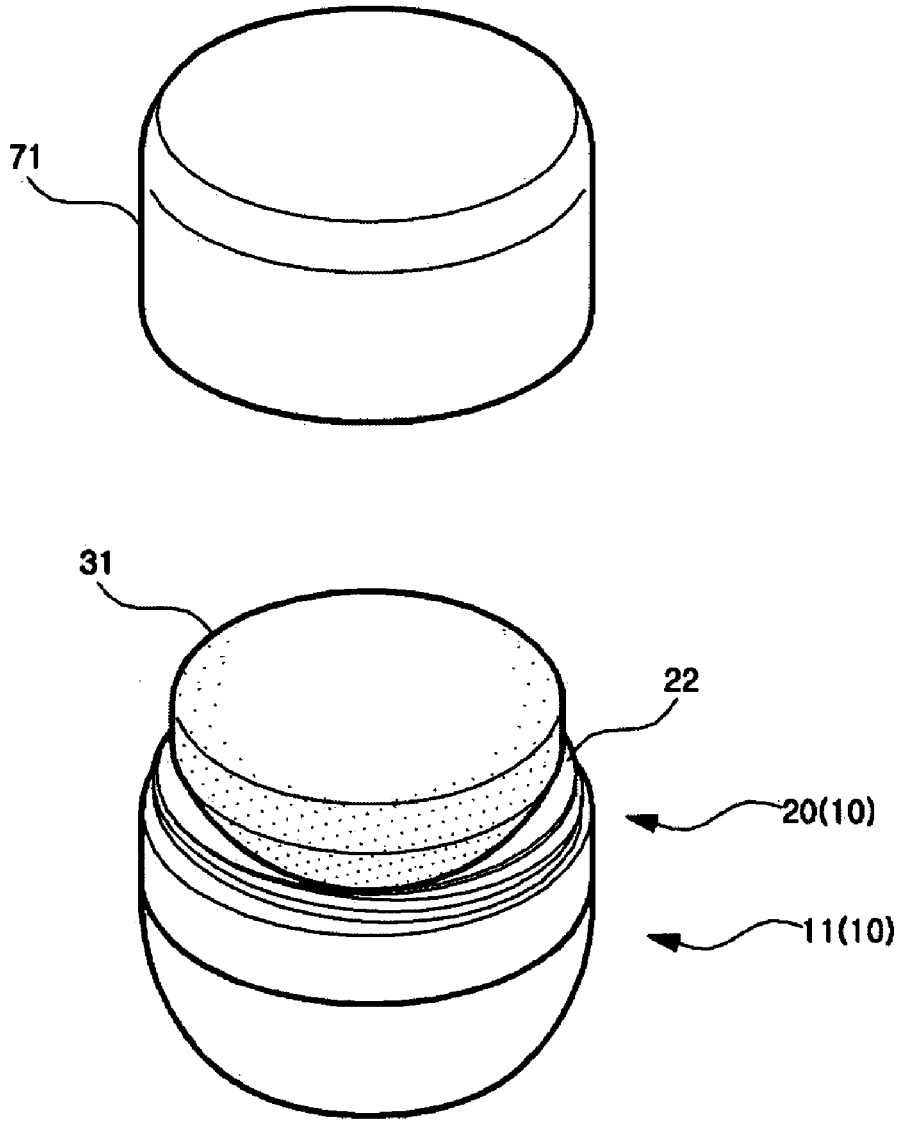
Figure 4:
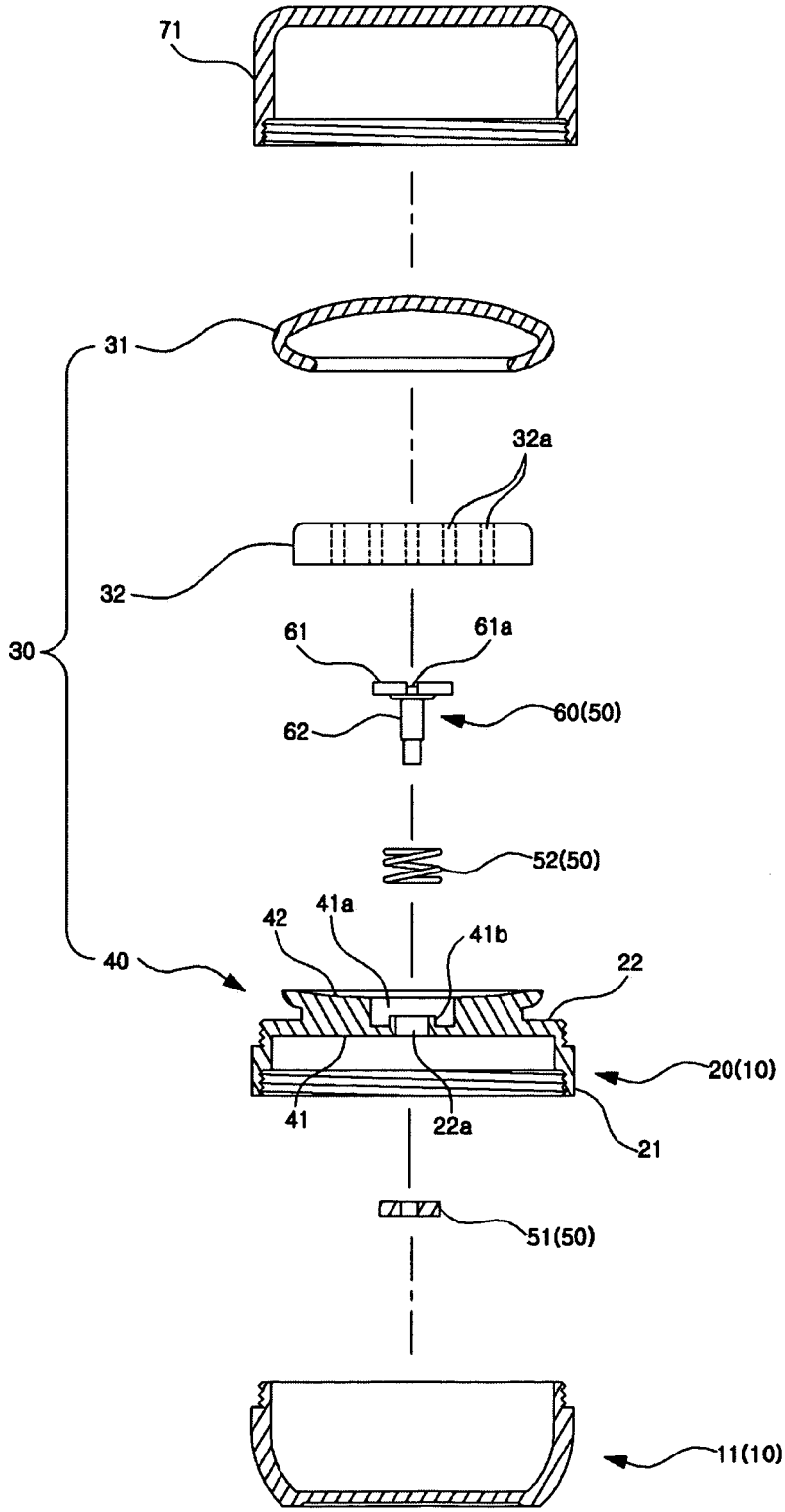
FIGS. 4 and 5 are exploded sectional views of a cosmetic powder appliance according to one embodiment of the present invention.
Figure 5:
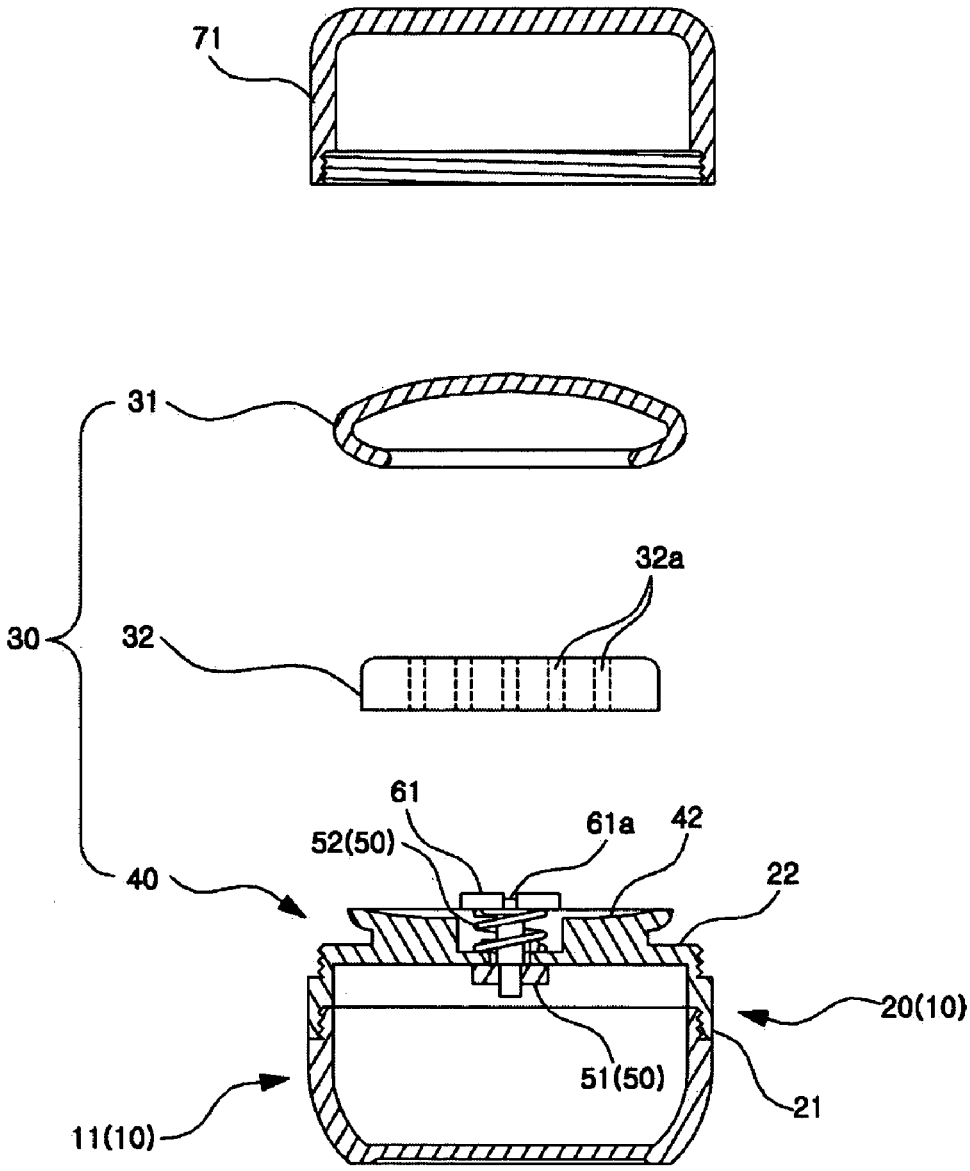
Figure 6:
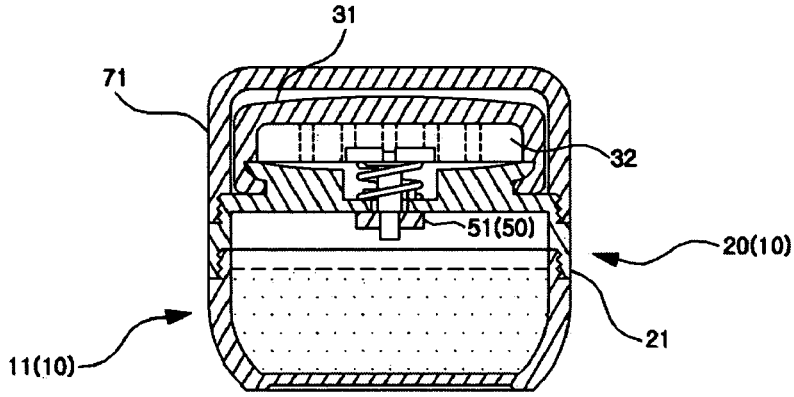
FIG. 6 is an assembled sectional view of a cosmetic powder appliance according to one embodiment of the present invention.

FIGS. 1 to 3 are exploded perspective views of a cosmetic powder appliance according to one embodiment of the present invention, FIGS. 4 and 5 are exploded sectional views of the cosmetic powder appliance according to one embodiment of the present invention, and FIG. 6 is an assembled sectional view of the cosmetic powder appliance according to one embodiment of the present invention.

As shown in FIGS. 1 to 6, the cosmetic powder appliance according to one embodiment of the present invention includes a powder receptacle 10, a puffer 30 formed at an upper portion of the powder receptacle 10, a cap 71 detachably coupled to the powder receptacle 10 in such a manner that the cap 71 surrounds the puffer 30, and a valve unit 50 installed in the puffer 30.

The powder receptacle 10 includes a lower powder receptacle 11 and an upper powder receptacle 20 screw-coupled to an upper portion of the lower powder receptacle 11. The upper portion of the lower powder receptacle 11 is opened.

The upper powder receptacle 20 has a cylindrical section 21 and a stepped section 22 formed at an upper portion of the cylindrical section 21.

The stepped section 22 is formed at a center portion thereof with a passage hole 22*a*.

The upper powder receptacle 20 having the above structure is screw-coupled with the upper end portion of the lower powder receptacle 11 in such a manner that the upper portion of the lower powder receptacle 11 is covered with the upper powder receptacle 20.

The puffer 30 includes a puffer head 40 formed at an upper surface of the stepped section 22, a puffer cover 31 for covering the puffer head 40, and a porous plate 32 interposed between the puffer cover 31 and the puffer head 40.

The puffer head 40 includes a column section 41 protruding from the upper surface of the stepped section 22 and a diffusing plate 42 formed at an upper portion of the column section 41. The diffusing plate 42 outwardly extends from an outer peripheral portion of the column section 41.

The column section 41 is formed at a center portion thereof with an exhaust hole 41*a* communicated with the passage hole 22*a*. A spring seat 41*b* is formed at a bottom of the exhaust hole 41*a* in such a manner that the passage hole 22*a* is surrounded by the spring seat 41*b*.

An upper surface of the diffusing plate 42 is inwardly inclined towards a center portion thereof. Accordingly, a cavity is formed between an upper surface of the diffusing plate 42 and a lower surface of the porous plate 32.

The porous plate 32 has a plurality of pores 32 and is made from soft materials, such as sponge.

The puffer cover 31 is fixed to the puffer head 40 through a slot formed between the stepped section 22 and the diffusing plate 42. The puffer cover 31 can be fabricated by using soft materials, such as pure cotton or sponge.

The valve unit 50 includes a lifting member 60, a valve plate 51 coupled to a lower end of the lifting member 60, and a spring 52 interposed between the lifting member 60 and the valve plate 51.

The lifting member 60 includes a lifting plate 61 and a lifting shaft 62 downwardly extending from a center of a bottom surface of the lifting plate 61.

The lifting plate 61 is formed at an outer peripheral portion thereof with four guide slots 61*a*.

The guide slots 61*a* are communicated with each other through a cross-shaped connection slot 61*b* formed at a center portion of the lifting plate 61.

The valve plate 51 is press-coupled with the lower end of the lifting shaft 62 in parallel to the lifting plate 61.

The spring 52 is supported on the spring seat 41*b* and extends lengthwise along the lifting shaft 62.

According to the lifting member 60 having the above structure, the lifting shaft 62 passes through the passage hole 22*a*, the valve plate 51 is disposed below the passage hole 22*a* and the spring 52 is interposed between the bottom surface of the exhaust hole 41*a* and the lifting plate 61.

Figure 7:
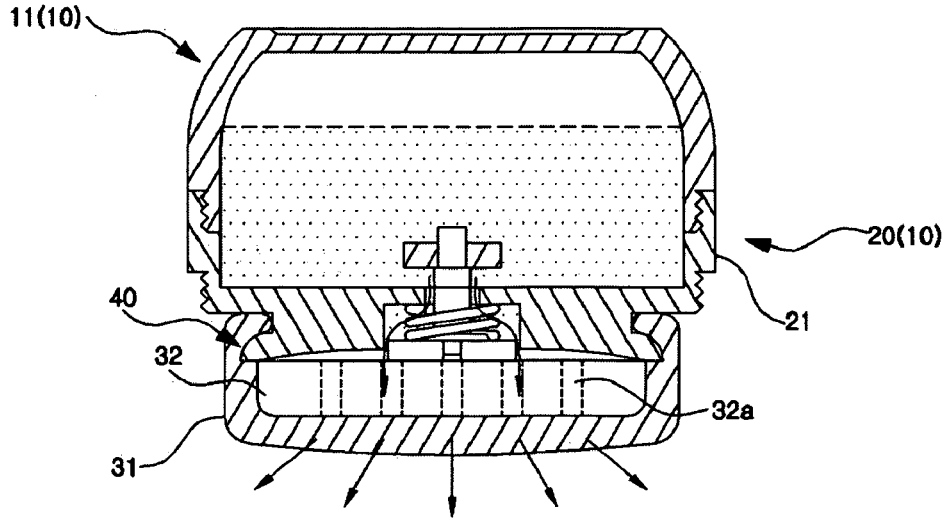
FIG. 7 is a view illustrating a powder exhaust path of a cosmetic powder appliance according to one embodiment of the present invention.
Figure 8:
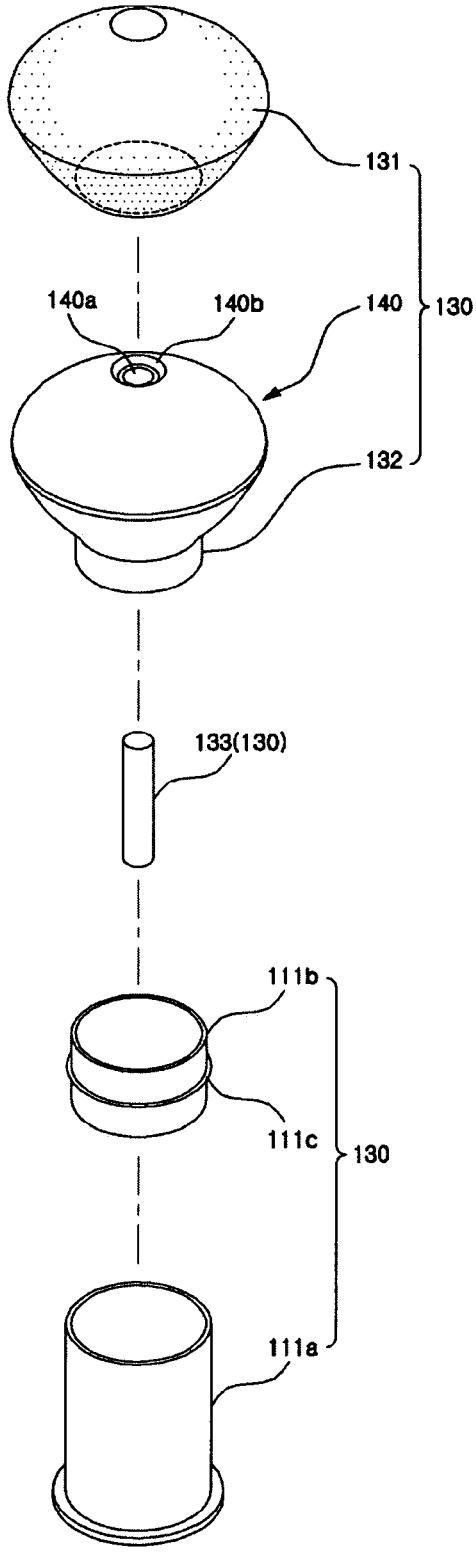
FIG. 8 PRIOR ART
FIG. 8 is an exploded perspective view of a conventional cosmetic powder appliance.
Figure 9:
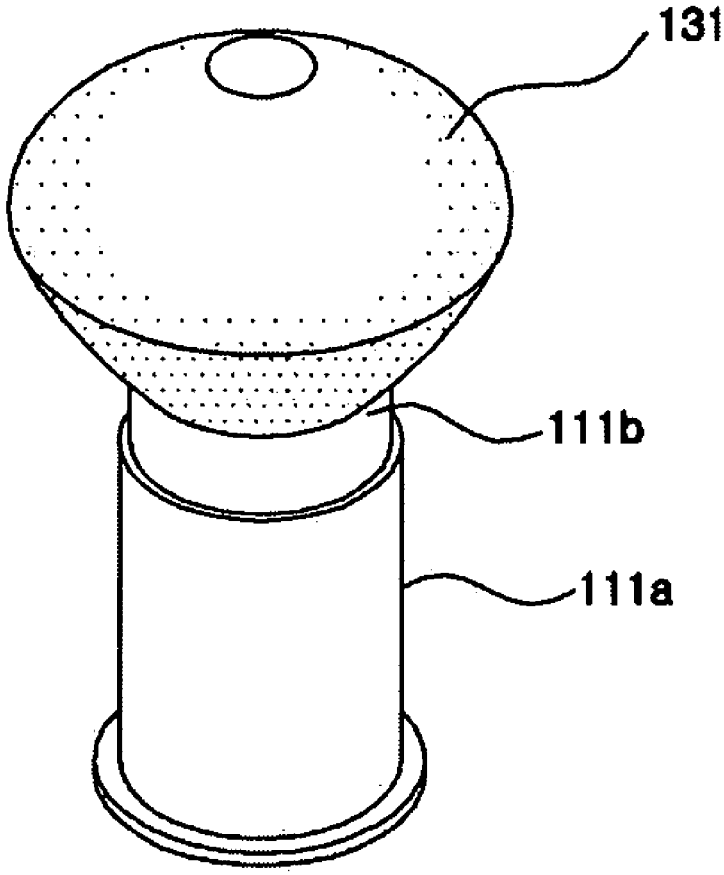
FIG. 9 PRIOR ART
FIG. 9 is an assembled perspective view of a conventional cosmetic powder appliance.
Figure 10:
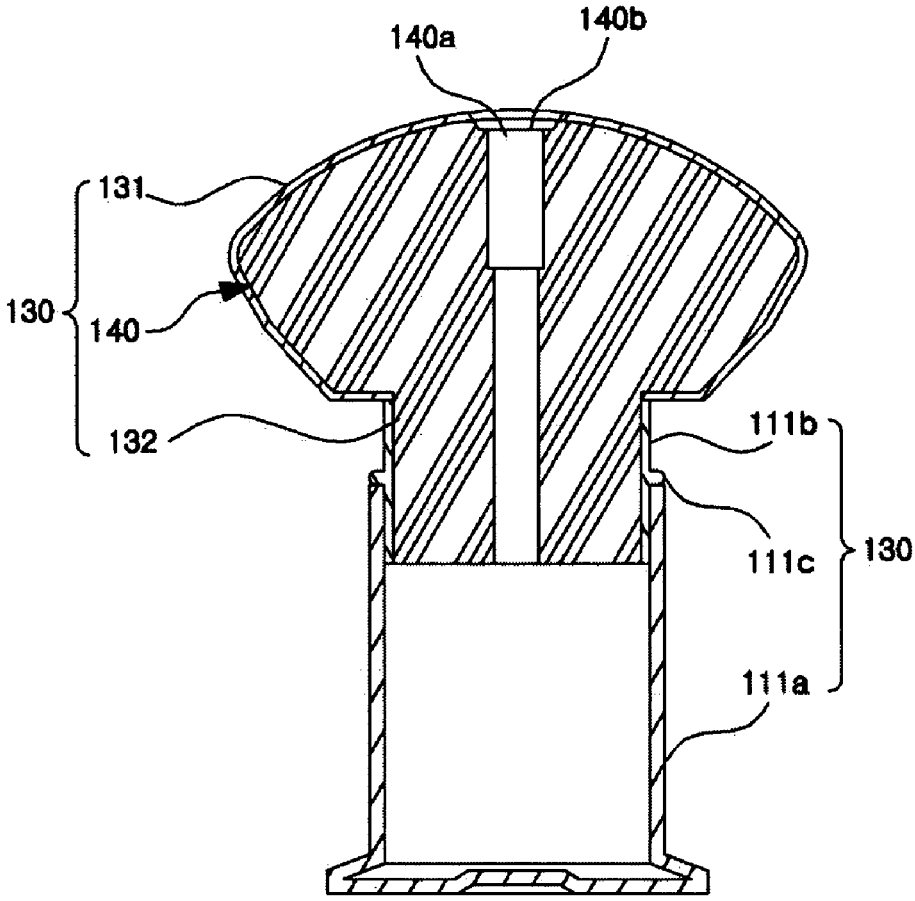
FIG. 10 PRIOR ART
FIG. 10 is an assembled sectional view of a conventional cosmetic powder appliance.

Hereinafter, an operation of the cosmetic powder appliance according to one embodiment of the present invention will be described with reference to FIG. 7.

First, the upper powder receptacle section 20 is separated from the lower powder receptacle section 11, and powder is stored in the lower powder receptacle section 11.

After that, the upper powder receptacle section 20 is coupled with the lower powder receptacle section 11.

In this state, the user touches the cosmetic area by using the puffer 30 while gripping the lower powder receptacle section 11.

Whenever the puffer 30 touches the cosmetic area, the lifting plate 61 is pressed towards the lower powder receptacle section 11 while compressing the spring 52.

If the lifting plate 61 is pressed towards the lower powder receptacle section 11, a gap is formed between the valve plate 51 and the stepped section 22. Thus, the powder stored in the lower powder receptacle section 11 is introduced into the passage hole 22*a* through the gap.

Then, the powder introduced into the passage hole 22*a* is collected in the exhaust hole 41*a* through the guide slots 61*a* of the lifting plate 61. The powder collected in the exhaust hole 41*a* through the guide slots 61*a* is widely distributed through the cross-shaped connection slot 61*b*.

The powder collected in the exhaust hole 41*a* may sequentially pass through the cavity formed between the upper surface of the diffusing plate 42 and the lower surface of the porous plate 32 and the pores 32*a* of the porous plate 32. Finally, the powder is applied to the cosmetic area through the puffer cover 31. Herein, the powder collected in the exhaust hole 41*a* is widely distributed through the diffusing plate 42 and uniformly distributed through the porous plate 32.

As mentioned above, according to the present invention, the passage hole 22*a* is opened whenever the puffer 30 touches the cosmetic area, so that the powder exhaust path is selectively communicated with the lower powder receptacle 11 when the user uses the cosmetic powder appliance.

In addition, since the guide slots 61*a* formed at the outer peripheral portion of the lifting plate 61 are communicated with each other through the cross-shaped connection slot 61*b*, the powder introduced into the exhaust hole 41*a* through the guide slots 61*a* can be prevented from being concentrated onto a predetermined portion of the puffer cover 31.

Furthermore, since the upper surface of the diffusing plate 42 is inwardly inclined towards the center of the diffusing plate 42, the powder can be distributed over the whole area of the puffer cover 31.

In addition, since the porous plate 32 having a plurality of pores 32*a* is interposed between the diffusing plate 42 and the puffer cover 31, the powder spread through the diffusing plate 42 can be prevented from being concentrated onto a predetermined portion of the puffer cover 31.

Although the present invention has been described in that the spring 52 is used as an elastic member, the present invention does not limit the kind of the elastic member. For instance, rubber or silicon in the form of a pipe can be used as the elastic member.

According to the present invention, the passage hole is opened only when the puffer touches the cosmetic area, so that the powder exhaust path is selectively communicated with the powder receptacle only when the user uses the cosmetic powder appliance. Therefore, the powder stored in the powder receptacle can be prevented from being exhausted to the exterior when the user does not use the cosmetic powder appliance.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A cosmetic powder appliance comprising:

a powder receptacle including a lower powder receptacle and an upper powder receptacle having a cylindrical section and a stepped section formed at an upper portion of the cylindrical section, the stepped section being formed at a center portion thereof with a passage hole, the cylindrical section being detachably coupled to an upper portion of the lower powder receptacle in such a manner that the lower powder receptacle is covered with the upper powder receptacle;

a puffer including a puffer head provided at an upper surface of the stepped section and formed at a center portion thereof with an exhaust hole communicated with the passage hole and a puffer cover for covering the puffer head; and a valve unit installed in the puffer head in order to selectively open the passage hole only when the puffer touches a predetermined cosmetic area, wherein the valve unit includes a lifting member having a lifting plate formed with a plurality of guide slots and a lifting shaft downwardly extending from a center portion of an underside of the lifting plate, a valve plate coupled to a lower end of the lifting plate in parallel to the lifting plate, and an elastic member installed lengthwise along the lifting shaft, the lifting shaft passes through the passage hole, the valve plate is aligned below the passage hole, and the elastic member is installed between a bottom surface of the exhaust hole and the lifting plate.

2. The cosmetic powder appliance as claimed in claim 1, wherein the guide slots are formed at an outer peripheral portion of the lifting plate and communicated with each other through a cross-shaped connection slot.

3. The cosmetic powder appliance as claimed in claim 1, wherein the puffer head includes a diffusing plate installed around the exhaust hole and having an upper surface inwardly inclined towards a center portion thereof.

4. The cosmetic powder appliance as claimed claim 3, wherein the puffer includes a porous plate having a plurality of pores, which are uniformly distributed, and being interposed between the puffer cover and the diffusing plate.

5. A cosmetic powder appliance comprising:

a powder receptacle including a lower powder receptacle and an upper powder receptacle having a cylindrical section and a stepped section formed at an upper portion of the cylindrical section, the stepped section being formed at a center portion thereof with a passage hole, the cylindrical section being detachably coupled to an upper portion of the lower powder receptacle in such a manner that the lower powder receptacle is covered with the upper powder receptacle;

a puffer including a puffer head provided at an upper surface of the stepped section and formed at a center portion thereof with an exhaust hole communicated with the passage hole and a puffer cover for covering the puffer head wherein the puffer head includes a diffusing plate installed around the exhaust hole and having an upper surface inwardly inclined towards a center portion thereof, wherein the puffer includes a porous plate having a plurality of pores, which are uniformly distributed, and being interposed between the puffer cover and the diffusing plate; and a valve unit installed in the puffer head in order to selectively open the passage hole only when the puffer touches a predetermined cosmetic area.

6. The cosmetic powder appliance as claimed in claim 2, wherein the puffer head includes a diffusing plate installed around the exhaust hole and having an upper surface inwardly inclined towards a center portion thereof.

7. The cosmetic powder appliance as claimed claim 6, wherein the puffer includes a porous plate having a plurality of pores, which are uniformly distributed, and being interposed between the puffer cover and the diffusing plate.

* * * * *